US006588159B1

(12) United States Patent
Cotton, Jr.

(10) Patent No.: US 6,588,159 B1
(45) Date of Patent: Jul. 8, 2003

(54) MULTIPURPOSE DOOR AND WINDOW JAMB ASSEMBLY

(76) Inventor: Richard D. Cotton, Jr., 15055 Driftwood Creek Rd., El Cajon, CA (US) 92021

( * ) Notice: Subject to any disclaimer, the term of this patent is extended or adjusted under 35 U.S.C. 154(b) by 0 days.

(21) Appl. No.: 09/677,811

(22) Filed: Oct. 3, 2000

(51) Int. Cl.[7] ..... E06B 1/04

(52) U.S. Cl. ..... 52/211; 52/717.01; 52/204.1; 49/504

(58) Field of Search ..... 52/210, 211, 212, 52/213, 204.1, 287.1, 717.01, 586.1, 586.2; 49/504, 505

(56) References Cited

U.S. PATENT DOCUMENTS

| | | | | | |
|---|---|---|---|---|---|
| 2,332,081 | A | * | 10/1943 | Hunt et al. | 403/294 |
| 2,651,814 | A | | 9/1953 | Lester, Jr. | |
| 2,711,564 | A | | 6/1955 | Jackson | |
| 2,886,860 | A | | 5/1959 | Zern | |
| 2,914,817 | A | | 12/1959 | Jackson | |
| 3,707,057 | A | | 12/1972 | Frydenberg | |
| 3,981,103 | A | | 9/1976 | McAllister | |
| 4,014,146 | A | * | 3/1977 | DiMascio et al. | 52/211 |
| 4,019,303 | A | | 4/1977 | McAllister | |
| 5,687,532 | A | * | 11/1997 | Torrey | 52/656.3 |
| 5,791,113 | A | * | 8/1998 | Glowa et al. | 52/586.2 |
| 5,857,299 | A | | 1/1999 | Gyllenberg et al. | |
| 5,901,511 | A | * | 5/1999 | Yoshida | 52/212 |
| 6,148,584 | A | * | 11/2000 | Wilson | 52/717.01 |
| 6,178,717 | B1 | * | 1/2001 | Loop | 52/714 |

* cited by examiner

*Primary Examiner*—Carl D. Friedman
*Assistant Examiner*—Naoko Slack
(74) *Attorney, Agent, or Firm*—Peter K. Hahn; David E. Heisey; Luce, Forward, Hamilton, Scripps, LLP

(57) ABSTRACT

A jamb assembly for a door and/or window opening in a wall, wherein a jamb member and a fascia member are mechanically connected, by various expedients that do not involve making a screw of nail hole in the fascia member. Such expedients include protrusion-and-groove connection and adhesive attachment.

12 Claims, 5 Drawing Sheets

MULTIPURPOSE DOOR AND WINDOW JAMB ASSEMBLY

The present invention is directed to jamb assemblies, such as door frame assemblies and window frame assemblies, and more particularly to assemblies including a jamb member and a fascia (or casing) member.

BACKGROUND OF THE INVENTION

Conventionally, jamb assemblies are built into door and window frames. The jamb assembly serves as an intermediate mechanical assembly between an unfinished opening in a wall, and the door or window that occupies the opening. More particularly, conventional jamb assemblies include jamb members and fascia members.

Jamb members (or jamb legs) line the interior faces of the opening in the wall, and generally make the interior surfaces of the opening more attractive, smooth and secure than the interior faces of the unfinished opening in the wall. The jamb members may also include a door stop protrusion to seal the edges of a door, or various other features structured to interface with window hardware.

Fascia members cover up a portion of a major surface of the wall in the vicinity of the opening. More specifically, fascia members are placed to cover the side surfaces of the jamb members and to cover the edges of the opening in the wall. Fascia members usually have the general appearance of a picture frame, and enhance the aesthetic appeal of the door or window. Fascia members may also help provide a better seal and enhanced thermal insulation in the vicinity of the opening. Conventionally, fascia members are made of wood, and are attached to the jamb members and/or the wall by screws or nails.

Although wood is an increasingly expensive and scarce material, wood works especially well for fascia pieces because wooden fascia pieces are highly amenable to being connected by screw or nail to jamb members. Also, nails or screws can be driven into the wood and then finished over so that the screw or nail heads are inconspicuous. This inconspicuousness is especially advantageous because a major purpose of fascia members is to improve the appearance of the wall and opening.

SUMMARY OF THE INVENTION

The present application deals with some potential problems in the above described prior art and some potential solutions to these potential problems. One potential problem with the above-described conventional jamb assemblies is that nail holes or a screw holes are generally driven through the fascia member in order to facilitate mechanical connection to the jamb member and/or the wall by screws or nails. This potential problem is not much of a problem with conventional wooden fascia members, because these members take a nail or screw hole quite well, without compromising the structural soundness or aesthetics of the jamb assembly.

However, new types of materials are being used to make fascia members and jamb members. Such new materials include composite materials, such as composite materials formed of epoxy and finely divided wood pulp, particles or fibers. Many of these new materials can be easily cracked or otherwise compromised by formation of a nail hole or a screw hole. Also, nail and screw heads tend to be conspicuous in the environment of composite materials, even when the screw or nail head is finished over.

In response to this perceived problem, the present invention involves various ways of attaching a fascia member to a jamb member and/or a wall in ways that do not involve making a hole in the fascia member. Such ways of attachment include providing for adhesive attachment, friction fit and/or force fit between the fascia member and the jamb member and the wall. Most preferably, both the jamb member and the fascia member are formed with grooves (or kerfs), and an intermediate piece (herein called a "spline") is partially inserted into both the kerf in the jamb member and the kerf in the fascia member to secure of the fascia member to the jamb member by frictive force, optionally supplemented by adhesive attachment.

According to one aspect of the present invention, a jamb assembly, for placement in an opening in a wall, includes a jamb member, a fascia member and a connector. The connector is structured to mechanically connect the jamb member to the fascia member, such that no holes need to be formed in the fascia member to effect the connection.

According to another aspect of the present invention, a jamb assembly, for placement in an opening in a wall, includes a jamb member, a fascia member and a spline. The jamb member has a jamb groove formed therein. Likewise, the fascia member has a fascia groove formed therein. The spline member, the fascia groove and the jamb groove are shaped and located so that a portion of the spline member protrudes into the jamb groove and a portion of the spline member protrudes into the fascia groove.

Further applicability of the present invention will become apparent from a review of the detailed description and accompanying drawings. It should be understood that the description and examples, while indicating preferred embodiments of the present invention, are not intended to limit the scope of the invention, and various changes and modifications within the spirit and scope of the invention will become apparent to those skilled in the art.

BRIEF DESCRIPTION OF THE DRAWINGS

The present invention will become more fully understood from the detailed description given below, together with the accompanying drawings which are given by way of illustration only, and thus are not to be construed as limiting the scope of the present invention. In the drawings.

DETAILED DESCRIPTION OF THE PREFERRED EMBODIMENTS

Figure 1:
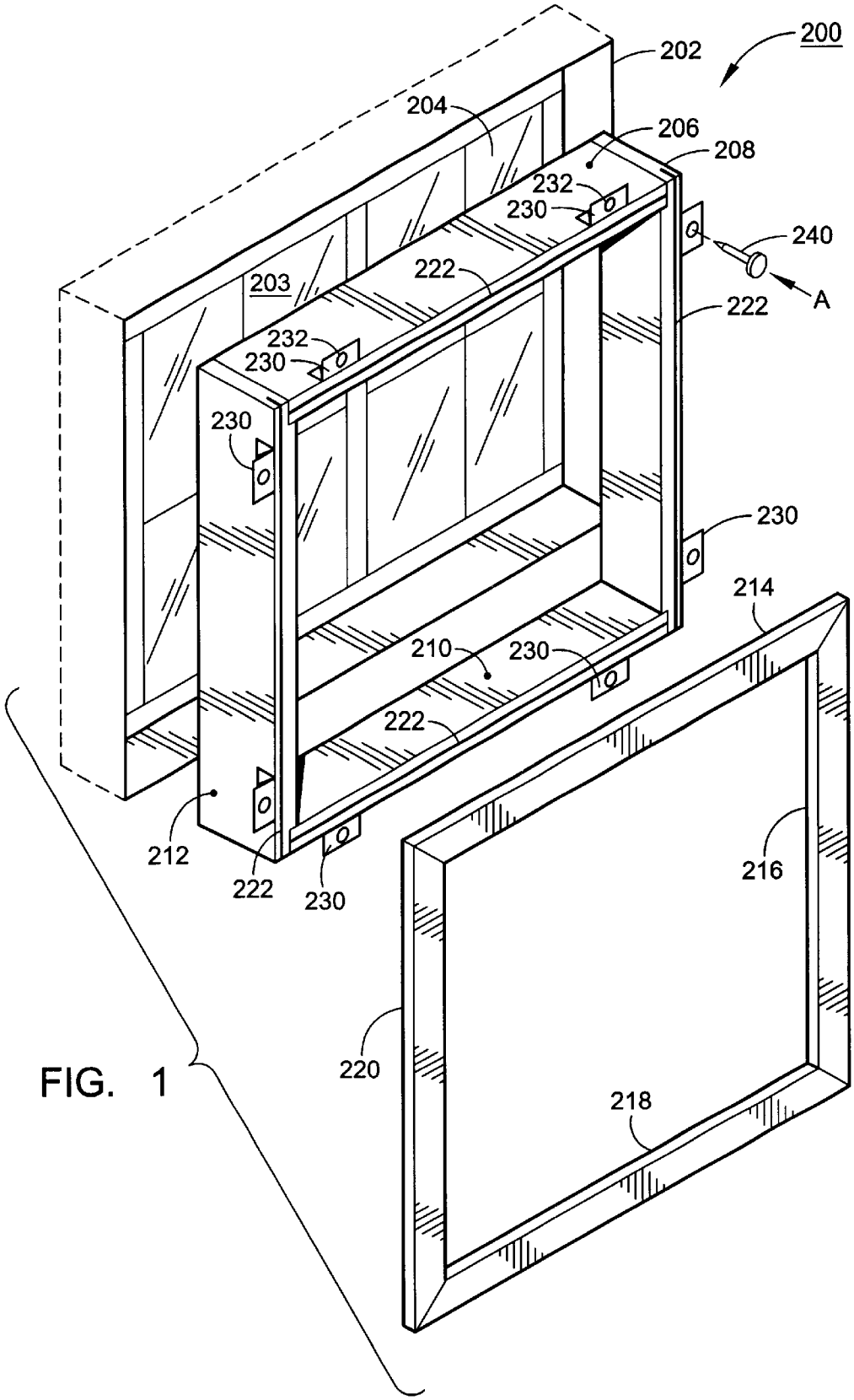
FIG. 1 is an exploded, perspective view of a first embodiment of a window jamb assembly according to the present invention.

Before plunging into a description of the Figs., some terms will now be defined.

Wall: as used herein, the word wall refers to any structure of generally planar shape which is capable of having an opening defined therein from its first major surface to its second major surface. Of course, many familiar walls are vertically oriented, so that door and/or window openings may be defined therein, but the term "wall" is used more broadly than that herein. For example, a ceiling section capable of having a skylight, or attic trap door, defined there through would also qualify as a wall.

To the extent that a patentee may act as its own lexicographer under applicable law, it is hereby directed that all words appearing in the claims section, except for the above-defined word "wall," shall take on their ordinary, plain and accustomed meanings (as generally evidenced by dictionaries and/or technical lexicons), and shall not be considered to be specially defined in this specification.

A first embodiment of a jamb assembly 200 will now be discussed with reference to FIGS. 1 to 4. Jamb assembly 200 is a window jamb assembly (with fascia members on one side only) that employs a kerf-and-spline attachment between jamb members and fascia members. Jamb assembly 200 also utilizes angled brackets to help: (1) attach the jamb members to the wall; and (2) help attach the fascia members to the jamb members.

Jamb assembly 200 includes wall 202, window opening 203, window 204, top jamb member 206, right side jamb member 208, bottom jamb member 210, left side jamb member 212, top fascia member 214, right side fascia member 216, bottom fascia member 218, left side fascia member 220, four splines 222, eight angled brackets 230, nail 240 and adhesive 242.

Wall 202 is a conventional wall of a conventional residential or commercial building. For example, wall 202 may be a wood frame or metal frame wall and may include sheetrock or plaster. Opening 203 in wall 202 is a conventional window opening. Conventional window 204 is inserted in opening 203 in the conventional way.

As shown in FIG. 1, the jamb members 206, 208, 210, 212 are attached respectively along the top right, bottom and left sides of opening 203. Preferably, jamb members 206, 208, 210, 212 are made of composite material or wood, but other materials may be used, such as metals and plastics. Jamb members 206, 208, 210, 212 serve to cover the sides of opening 203 in wall 202, which makes the opening sturdier and more attractive. Also, the jamb members can help seal cracks around the window 204. As explained in more detail below, the jamb members are formed with kerfs in order to facilitate the attachment of the fascia members thereto.

Fascia members 214, 216, 218 and 220 form an attractive frame that frames window 204. As explained below in more detail, fascia members 214, 216, 218, 220 are attached to the jamb members such that no holes (such as screw or nail holes) need to be made in the fascia pieces. This means that the exposed fascia surfaces (that is, the surfaces that face away from wall 202 maintain smooth attractive surfaces.

Fascia members 214, 216, 218, 220 can be formed from any material, such as wood, metal or plastic. However, fascia members 214, 216, 218, 220 are preferrably made of composite material, such as paintgrade, medium density fiberboard. Composite materials, such as medium density fiberboard, are growing in popularity, but these materials often cannot be easily finished to conceal nail holes and nail heads. One advantage of at least some embodiments of the present invention is that no nails need be driven through the fascia members, so that no nail holes or heads need be concealed. This makes the present invention especially suitable for use with fascia members made of all types of materials, prefinished or otherwise.

Figure 4:
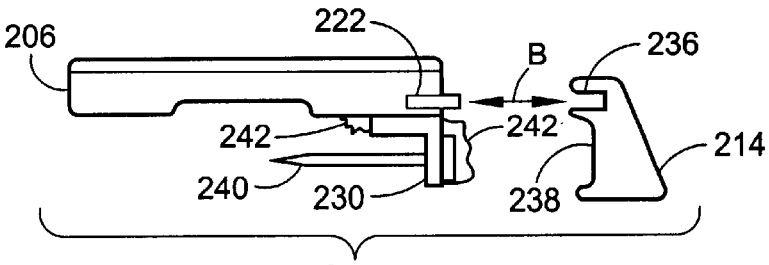
FIG. 4 shows another edge view of the jamb member of FIG. 2.
Figure 2:
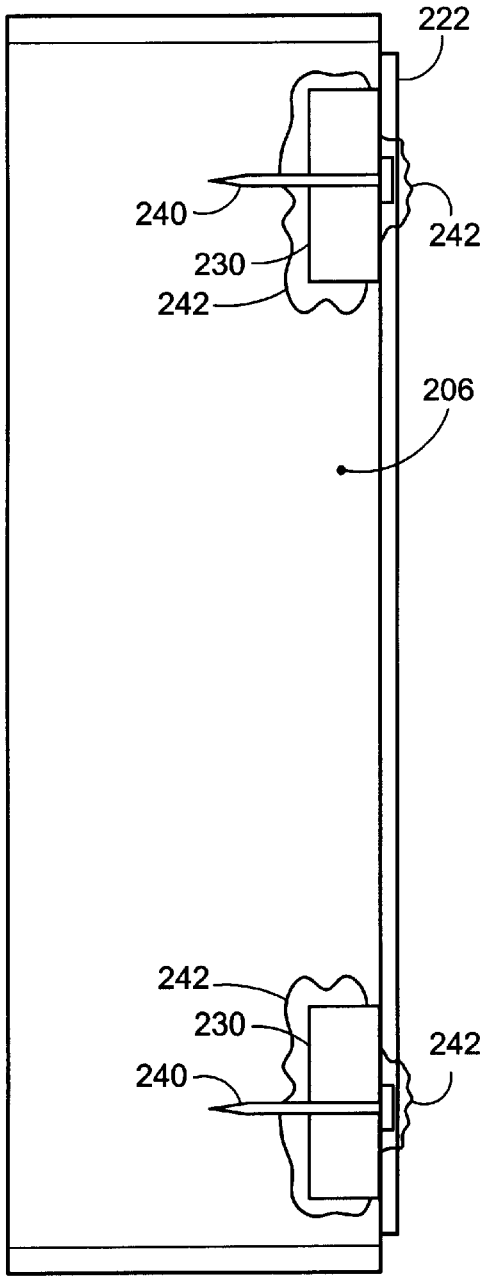
FIG. 2 shows an unexposed top view of a jamb member of the embodiment of FIG. 1.
Figure 3:
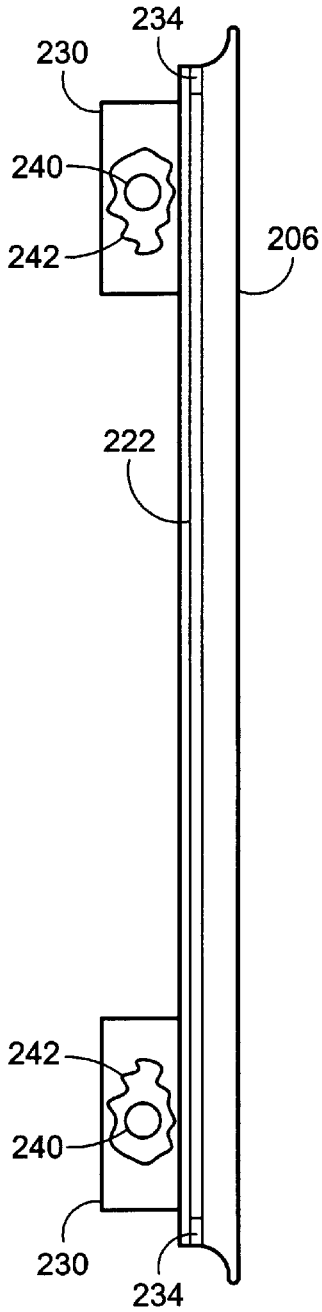
FIG. 3 shows an edge view of the jamb member of FIG. 2.

As shown in FIGS. 2, 3 and 4, two angled brackets 230 are attached to each jamb member by adhesive 242. Alternatively, the brackets could be attached to the jamb members by staples, nails or the like. Preferably, the angled brackets are made of 26 gauge sheet metal bent into a right angle shape. Each angle bracket has a nail hole 232 formed therein. While this preferred embodiment utilizes sheet metal, it is noted that aluminum, tin and other types of materials can be used to make the various brackets. The angled brackets serve two functions: (1) to help secure jamb members 206, 208, 210, 212 to wall 202; and (2) to help secure fascia members 214, 216, 218, 220 to respective jamb members 206, 208, 210, 212. The angled brackets are used to secure the jamb members to the wall by driving nails 240 in the direction of arrow A (see FIG. 1) through the nail holes 232 of the angled brackets and into wall 202.

The attachment between the jamb members and the fascia members will now be explained. Jamb members 206, 208, 210, 212 are attached to respective fascia members 214, 216, 218, 220 in two different ways: (1) by a kerf-and-spline connection; and (2) by the angled brackets.

First, the kerf-and-spline connection will be explained with reference to FIGS. 2, 3 and 4. Each jamb member is formed with kerf 234 (see FIG. 3). The kerf is basically a groove, preferably a rectangular-profiled groove. The kerf can be formed by any conventional groove forming technique, such as cutting the kerf out of the jamb member (during jamb member fabrication or at a later time), or by extruding the jamb members to have kerfs.

Splines 222 are inserted into each kerf 234 such that a portion of each spline 222 resides in kerf 234, and a portion of each spline 222 protrudes from kerf 234. Splines 222 are shaped to mate with the kerfs 234. In this preferred embodiment, the splines have a long, rectangular prismatic shape, in order to better mate with the rectangular profile kerfs 234. The splines 222 are secured into the kerfs by force fit and/or friction fit. Alternatively, adhesive could be used to augment the connection between kerfs 234 and splines 222.

As shown in FIG. 4, fascia members 214, 216, 218, 220 are also formed with kerfs 236. As shown by arrow B in FIG. 4, kerfs 236 formed in the fascia members are fit onto the portion of splines 222 that protrude from the jamb members. In this way, fascia members 214, 216, 218, 220 are friction fit and/or force fit to splines 222 and to respective jamb members 206, 208, 210, 212. The attachment between splines 222 and kerfs 236 can be augmented by appropriate adhesive. For many embodiments of the present invention, this kerf-and-spline attachment will be sufficient in itself to secure the fascia members to the jamb members, without the additional attachment provided by the angled members as explained below.

Now adhesive attachment between fascia members 214, 216, 218, 220 and angled brackets 230 will be discussed. When fascia member 214 is placed onto jamb member 206, as shown in FIG. 4, groove 238, formed in fascia member 214 accommodates the heads of nails 240. However, adhesive 242, such as conventional construction adhesive, can be placed over the nail heads and on the angled brackets 230, as shown in FIGS. 2 and 3. In this way, adhesive 242 helps secure the angled brackets 230 to the inner face of groove 238 (see FIG. 4) formed in fascia piece 214. Alternatively, adhesive attachment between the fascia members and the jamb members and/or angled brackets could be effected even without any protrusion-and-groove or kerf-and-spline structures, although it might be difficult to provide secure enough attachment for some applications in this manner. It will be appreciated that this adhesive attachment provides attachment between jamb members and fascia members, without requiring any screw holes or nail holes to be made in the fascia members.

Figure 6:
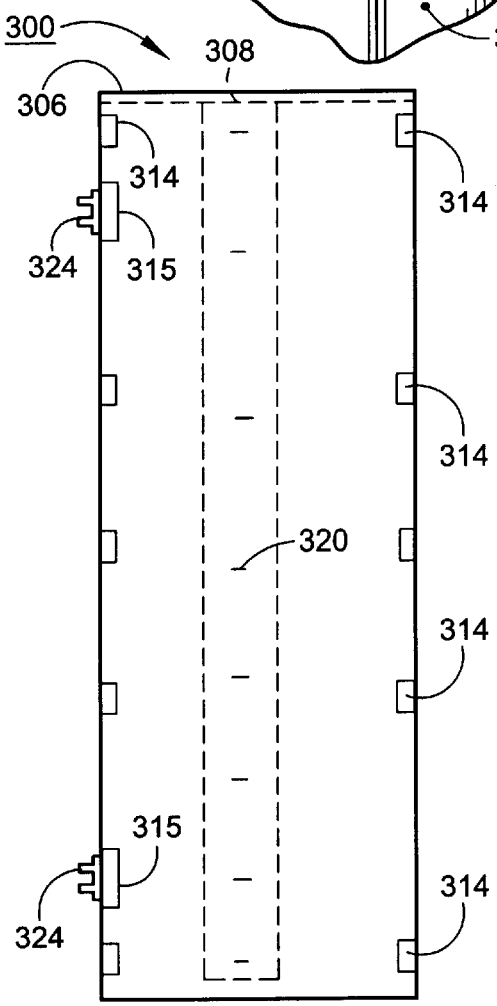
FIG. 6 is a rear view of the hinge-side jamb member of the embodiment of FIG. 5.
Figure 7:
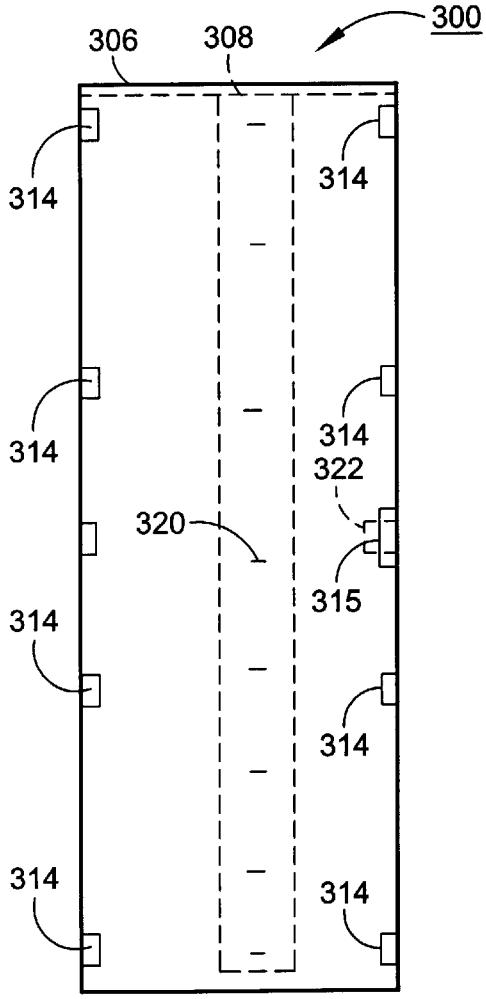
FIG. 7 is a rear view of the strike-side jamb member of the embodiment of FIG. 6.

Jamb assembly 300 for a door opening in wall 304, will now be discussed in connection with FIGS. 5 to 7. Jamb assembly 300 includes wall framing 302, wall panels 304, jamb members 306, door stops 308, fascia members 310, spline 312, short angled brackets 314, long angled brackets 315, adhesive 316, nails 318, staples 320, doorknob hardware, and hinge hardware 324.

Door stops 308 are present in order to securely define a shut position for the door (not shown). Door stops 308 are preferrably made of composite or wood, and are nailed to jamb members 306 by staples 320. Despite the fact that jamb members 306 and door stops 308 may be made of composite, staples 320 may still be used to effect attachment therebetween because staples 320 are nailed into the faces of jamb members 306 that will face the wall and not be exposed to view.

Short angled brackets 314 and long angled brackets 315 are attached by adhesive (not shown) to jamb members 306. Alternatively, this attachment could be effected by staples, nails and/or a combination of these various attachment types. As shown in FIG. 5, angled brackets 314, 315 are nailed to wall 304 by nails 318 in order to secure jamb members 306 to the wall. As shown in FIGS. 6 and 7, long angled brackets 315 provide greater mechanical support and are therefore used in the vicinity of doorknob hardware 322 and hinge hardware 324 because these areas tend to experience higher localized stress as the doorknob and hinges are operated to open and shut the door. Long angled brackets 315 are secured by 2 or 3 nails for better holding and added strength.

Some additional guidelines for located angled brackets on door heads will now be provided. Preferrably, angled brackets should be placed at least in the proximity of each end of the jamb, these end brackets being centered about 3 inches from the end of the jamb member itself. For jamb members longer than 28 inches, additional brackets should be used. These additional brackets should be evenly spaced between the end brackets at intervals of roughly 12 inches (more or less depending upon the length of the jamb member).

Similarly to above-described jamb assembly 200, splines 312 are inserted into kerfs formed in jamb members 306. In some preferred embodiments, the splines do not extend all the way to the ends of the jamb members in order to reduce the amount of alignment required and thereby make installation easier. Preferably, the friction fit between the splines and the kerfs is supplemented by adhesive (not shown).

Figure 5:
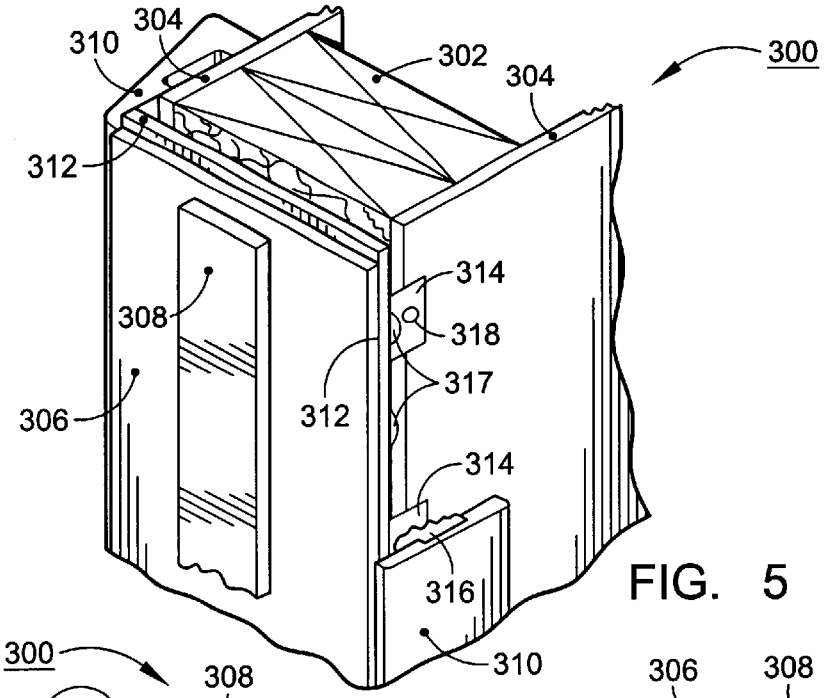
FIG. 5 is a perspective view of a doorjamb assembly according to the present invention.

As can be seen in FIG. 5, fascia members 310 also have kerfs, which are placed onto the portion of splines 312 that protrude from jamb members 308 in order to effect attachment between the jamb members and the fascia members without the need to drive any nail or screw holes in the fascia members. As previously stated, this is a good thing. As shown in FIG. 5, the attachment between the jamb members and the fascia members can be supplemented by adhesive 316. As shown in FIG. 5, additional adhesive 317 is located at the backside of spline 312 and approximately midway between brackets 314.

Figure 8:
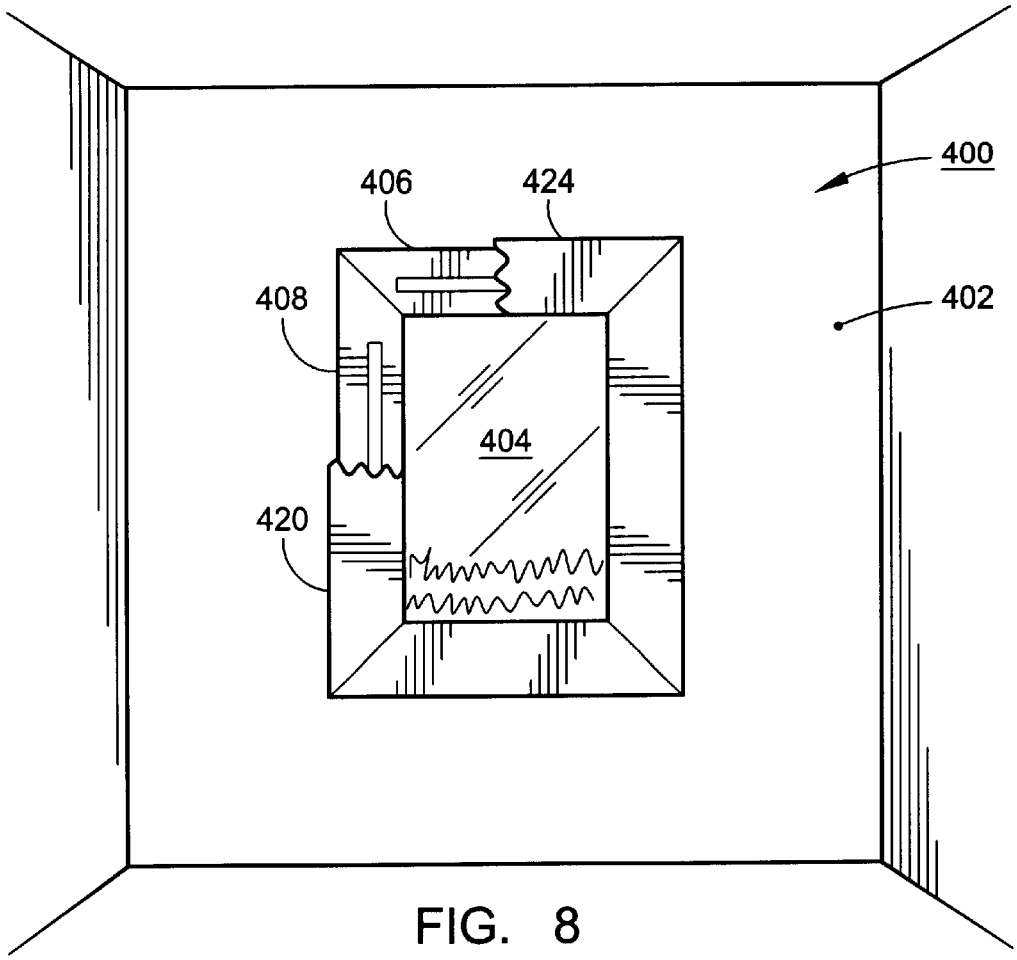
FIG. 8 is a partially cut-away view of a second embodiment of a window jamb assembly according to the present invention.
Figure 9:
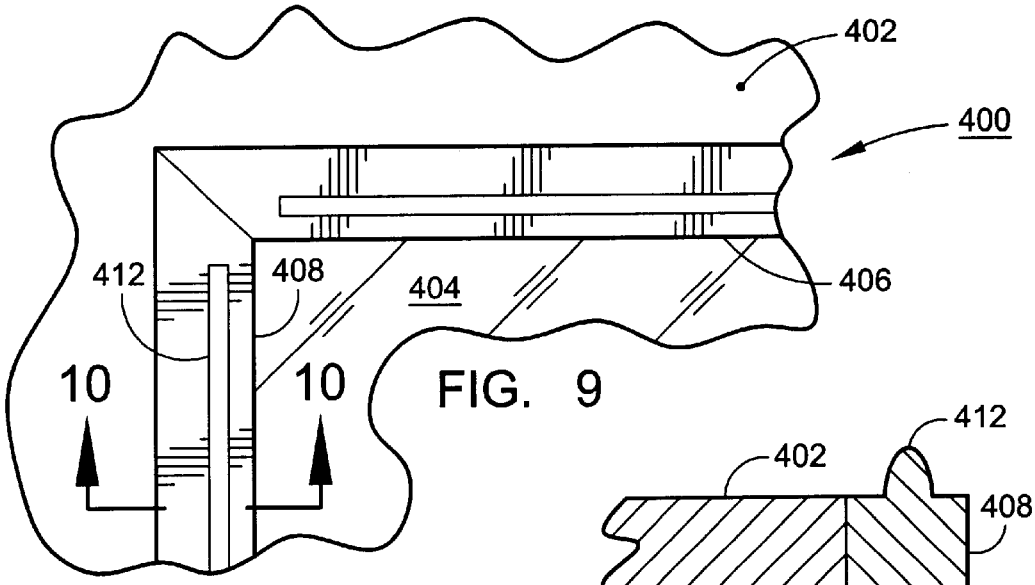
FIG. 9 shows a more detailed view of the jamb assembly of FIG. 8.
Figure 10:
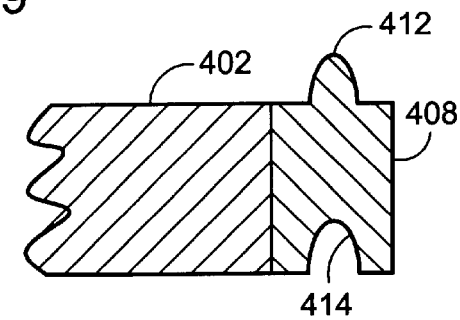
FIG. 10 is a cross-section of the jamb member of the window jamb assembly of FIG. 1.
Figure 11:
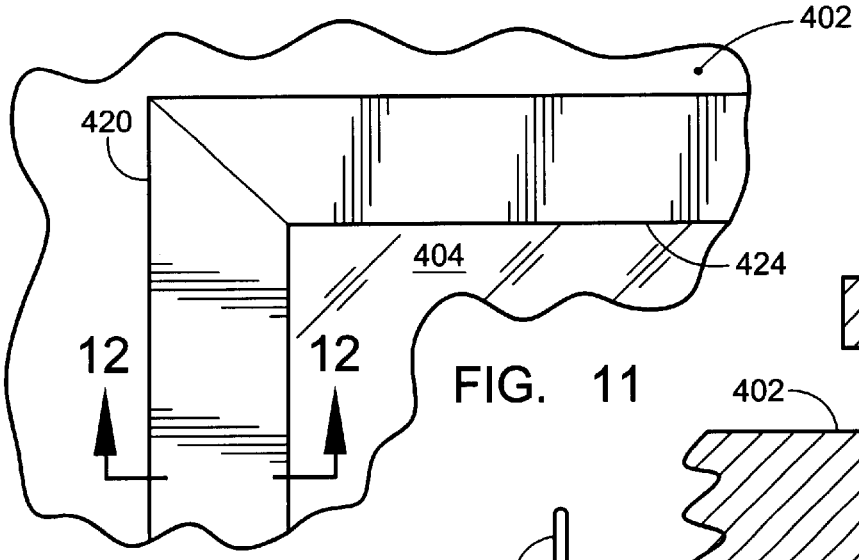
FIG. 11 shows a more detailed view of the jamb assembly of FIG. 8 when the fascia members are in place.

FIGS. 8 to 12 show an exemplary jamb assembly 400 according to the present invention. Jamb assembly 400 includes jamb member 406, jamb member 408, fascia member 416 and fascia member 420. As shown in FIGS. 9 and 11, jamb assembly 400 is located within and mechanically connected to opening 404 defined in the section of a wall 402.

As shown in FIG. 8, jamb members 406 is mechanically connected to a top edge of opening 404 in wall 402. The connection between jamb member 406 and wall 402 may be effected in many different ways, such as by nails, screws and/or adhesive. Similarly, jamb member 408 is connected to the left hand edge of opening 404. FIG. 10 shows a cross-sectional view of jamb member 408, so that protrusion 412 and groove 414 formed in jamb member 408 can be observed. Protrusion 412 and groove 414 are used to help secure fascia members 416, 420 to jamb member 108, as explained below in connection with FIG. 12.

Figure 12:
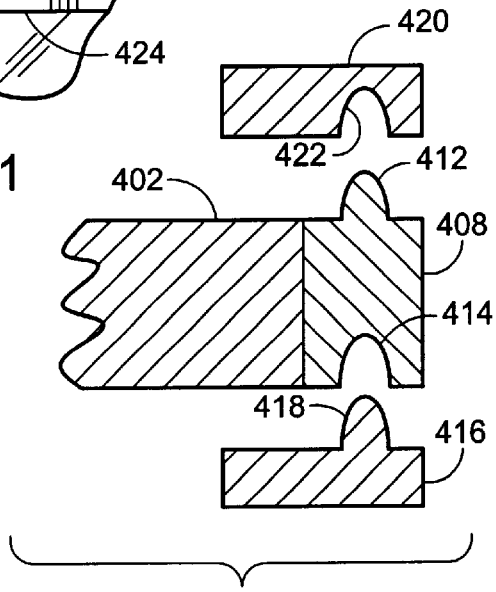
FIG. 12 is a cross-section of the jamb and fascia members of the window jamb assembly of FIG. 8.

FIGS. 11 and 12 show jamb assembly 400 when fascia members 420 and 424 are put into place. More particularly, FIG. 12 shows two exemplary ways that a jamb member and a fascia member can be affixed to each other using a protrusion-and-groove connection means. As shown in FIG. 12, fascia member 420 is affixed to jamb member 408 because protrusion 412 of jamb member 408 fits into groove 422 of jamb member 420 by a friction fit or a force fit. In this example, the protrusion is on the jamb member and the groove is on the fascia member.

As the second exemplary arrangement shown in FIG. 12, fascia member 416 is affixed to jamb member 408 because protrusion 418 formed in fascia member 416 is friction fit or force fit into groove 414 defined in jamb member 408. Although protrusions 412, 418 are shown as being unitary with their respective members, this is not necessarily required. While jamb assembly 400 is shown in FIG. 12 with fascia member 420 disposed on the interior side of the wall and fascia member 416 disposed on the exterior side of the wall, it will be appreciated that many jamb assemblies provide fascia members on one side of the wall only (usually the interior side only).

Also, adhesive, such as construction adhesive, may be applied at the protrusion-and-groove joints in order to help constrain the fascia member to the jamb member. As a further alternative, when adhesive is used, there need not even be a protrusion-and-groove joint at all. More particularly, in this case, the adhesive may supply the bulk of the constraint between fascia member and jamb member.

Figure 14:
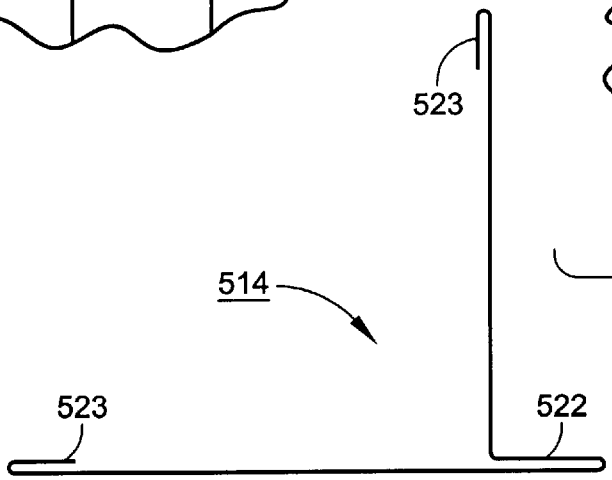
FIG. 14 is a detailed view of a one piece metal spline and nailing flange of the door jamb assembly embodiment of FIG. 13.
Figure 13:
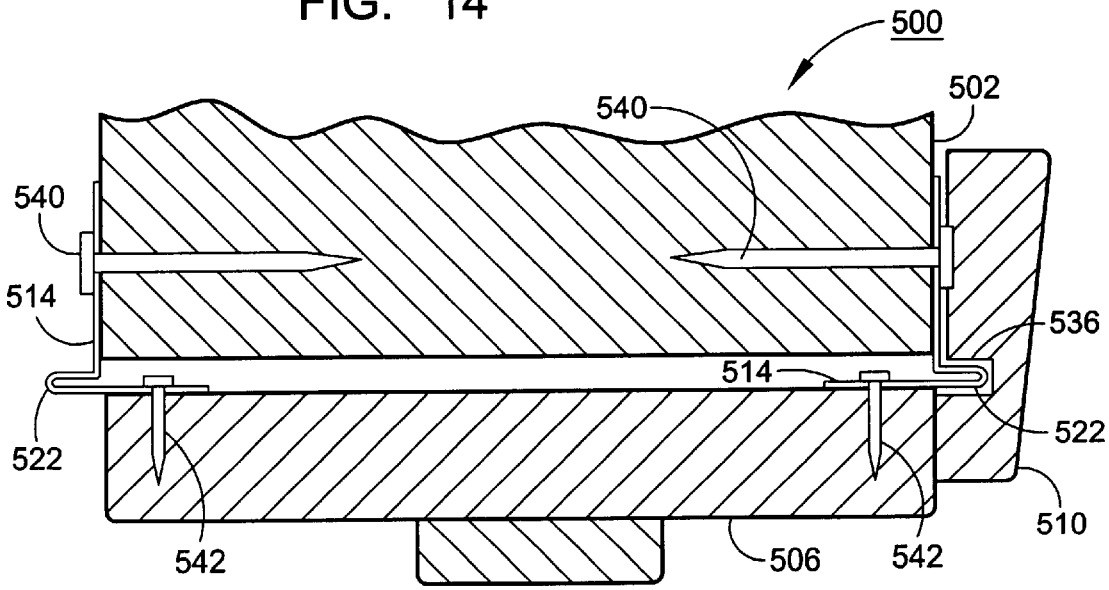
FIG. 13 is a cross-section of a second embodiment of a door jamb assembly according to the present invention.

FIGS. 13 and 14 show a preferred jamb assembly 500, according to the present invention. Jamb assembly 500 includes wall 502, jamb member 506, fascia member 510, splined bracket 514, all-mount nails 540 and jamb-mount nails 542.

This preferred assembly employs a splined bracket 514, shown in FIG. 13, which is a single piece that serves the functions of both the angled brackets and the splines discussed above in connection with the previous embodiments. Preferrably, splined bracket 514 is made of 26 gauge sheet metal, bent generally into a right angle shape. Splined bracket 514 includes end portions 523 and spline portion 522. End portions 523 are bent at an approximately 180 degree angle in order to minimize sharp edges. Spline portion 522 extends away from the right angle bend in the splined bracket, approximately perpendicular to one of the legs of the splined bracket.

Alternatively, splined bracket 514 could be made of other materials, such as extruded aluminum or synthetic materials. If the material used to form splined bracket 514 is not susceptible to bending, then the shape may be slightly modified. For example, end portions 523 could be omitted, and spline portion 522 could be formed as a unitary protrusion.

Shifting the focus back to FIG. 13, jamb member 506 is nailed to two splined brackets 514 by jamb-mount nails 542 (the nail heads are exaggerated in size for clarity of illustration). Alternatively, the splined brackets could be constrained to the jamb member by adhesive.

Once the splined brackets are attached to the jamb member, the splined brackets can be nailed into wall 502 by wall-mount nails 540. Although FIG. 13 shows a gap between jamb member 506 and wall 502 for clarity of illustration, it may be more preferable to have the jamb member direcctly abut the wall, in order to provide better structural support.

Fascia member 510 includes kerf 536. Fascia member 510 is attached to wall 502 and jamb member 506 by inserting spline portion 522 of splined bracket 514 into kerf 536. The attachment between the spline portion and the kerf may be augmented by adhesive (not shown). Note that no nail holes need to be driven through fascia member 510 to effect this attachment.

Splined bracket 514 may extend the entire length of jamb member 506, or alternatively, shorter splined brackets 514 may be placed intermittently along the length of jamb member 506.

When modified, according to the present invention, a doorjamb or window jamb and any type of casing can be installed without any finish surface nailing. Prefinishing with paint, stain, or other finish, may be applied before installation of the jamb and casing. Also, door or window jambs and casings, according to the present invention, may be installed in wood or metal stud framing. Jamb assemblies according to the present invention can also be used on all door and window shapes including square, rectangle, arched, or any radius opening that requires a jamb and casing.

Below, an inventive modification procedure to modify a conventional jamb assembly according to the present invention will be set forth.

Materials Required:

(1) One pair doorjamb legs and jamb head.

(2) Two sets door casing consisting of 2-right hand mitered legs, 2-left hand mitered legs, 2-double mitered casing heads.

(3) Two door stops cut to match door height; one door stop cut to match door width.

(4) 4⅛"×½"×77½" hardboard spline strips, 2⅛"×½" door width hardboard spline strips. Making splines shorter at top of jamb legs makes installing casing much faster and easier (5) 23⅞"×⅞"×2 ½" metal brackets (angled brackets), 3⅞"×⅞"×5" metal brackets (angled brackets).

(6) ½" screws, staples, or nails to attach brackets to backside of jamb leg.

(7) Carpenters' glue to attach splines to jamb.

The Procedures With Respect to the Jamb:

(1) Prepare jamb for hinges and lock strike same as any prefit or prehung doorjamb, but do not install door hinges.

(2) At the four edges or the doorjamb and the two edges of the door head, cut a ⅛"×⅜" kerf or slot the entire length of the jamb leg and jamb head.

(3) Place the door stop face down. Place the hinge side of the doorjamb on top of the stop face down. Adjust the door stop to the correct position for the door thickness. Nail the door stop from the back of the doorjamb and secure in place.

(4) Place the other door stop face down, and place the strike side of the doorjamb on top of the stop, face down. Adjust the door stop to the correct position for the door thickness. Nail the door stop from the back of the jamb and secure in place.

(5) Repeat step (4) to secure the stop at the jamb head.

(6) With the stops nailed in place, the ⅛"×½"77½" hardboard splines are glued to in the four kerfs or slots in the jamb legs, starting at the bottom of the leg and moving to the top. The spline should be 2 ½" to 3" from the top of the jamb. Next, install the splines in the two kerfs or slot in the jamb head.

(7) Install the hinges on the jamb leg.

(8) Place the jamb leg with the hinges installed face down. Center the two 5" metal brackets at the center of the hinge, and flush the edge of the jamb and secure with nails or screws.

(9) From the top of the jamb leg on the same side as the two 5" brackets just installed, equally space 5 (five) of the 2 ½" brackets and secure flush with the edge of the jamb in the same manner as the 5" brackets.

(10) On the opposite side of the same jamb leg and straight across from the 2 ½" brackets just installed, place 5 (five) more 2 ½" brackets and secure flush on the edge in the same manner as the other side.

(11) Place the strike side jamb leg face down, at the strike prep, center 1-5" bracket and secure with nails or screws, flush with the edge of the jamb. From the top of the jamb equally space 4 (four) 2 ½" brackets and secure flush with the jamb edge in the same manner as the other brackets.

(12) On the opposite side of the same jamb leg and straight across from the five brackets just installed, place five more of the 2 ½" brackets and secure in the same manner as the other side.

(13) Place the jamb head face down, at 3" from each end of the head, install four of the brackets flush with the edge, in the same manner as on the legs.

(14) If the jamb head is larger than 26" two or more additional 2 ½" brackets will need to be installed centered between the two brackets already installed.

(15) This completes the modification of the jamb and head.

The Procedure With Respect to the Casing (Fascia):

(1) Miter the casing legs, two right hand, two left hand and cut to the correct length to fit jamb height.

(2) Miter the 2 two casing heads at both ends to fit on the jamb.

(3) On the back of all casing members cut a ⅛"×3⁄16" kerf or slot that the spline on the jamb will fit into.

(4) This completes the modification of the casing sets.

The Procedure for Door Installation:

(1) Check that all components of the jamb, casing, and door are at the opening where they are to be installed.

(2) Check the rough opening for correct height, width, wall thickness, plumb, level, square, and cross-sight.

(3) If steps (1) and (2) set forth above are complete and correct, proceed to next step. If not, do not proceed until corrections are made.

(4) Take the hinge leg of the jamb and slightly bend the metal brackets to fit around the wall.

(5) Place the jamb leg in the opening by tilting the top of the jamb leg toward the top of the opening and allowing the top brackets to fit around the stud and drywall. Push the bottom of the jamb in towards the opening. While watching that the other brackets on the jamb fit into place around the drywall, keep pushing the jamb towards the stud and drywall until the jamb is in the opening and all the brackets are in place outside the drywall.

(6) With the hinge side of the jamb in place, slightly bend all the other brackets on the head and the strike side of the jamb before continuing.

(7) The jamb head is installed next. Position the jamb head so that the door stop, that has been adjusted for the door thickness, is on the same side as the hinges on the hinge jamb leg. Place the head in the opening with the end that fits into the hinged leg, tilted up and push into the rabbet joint while watching that the brackets fit around the drywall the same as the hinge leg keep pushing upward until all the brackets are fit around the drywall, and until the backside of the head jamb is touching the header on the strike side. A nail in one of the brackets may be needed to hold the head in place while the other jamb leg is installed.

(8) Place the strike side jamb leg in the opening with the top tilted towards the top of the opening and fit the top brackets around the stud and drywall. Push the bottom of the jamb leg toward the stud making sure that all the brackets fit around the drywall. With the strike jamb leg in place, remove the nail that is holding the head in place and fit the rabbet joint together.

(9) Install the door on the hinges and pin into place.

(10) Slowly close the door into the jamb. Moving the jamb legs or lifting the jamb may be required to fit the door into the jamb.

(11) From the hinge side of the door, center the door and the jamb in the opening, making sure that the brackets are outside the drywall. Using a 1 ½" roofing nail tack the top bracket located at the hinge side head to hold in place while door is adjusted.

(12) Plumb the hinge side of the door making sure that the brackets are still wrapped around the drywall. When plumb, nail the bottom 2½" bracket with a roofing nail.

(13) At the top hinge push or pull to adjust margin, at both sides of the door at the top, to ⅛" between the door and jamb and nail the 5" bracket in the center. Do not adjust head margin at this time.

(14) At the bottom hinge push or pull to adjust the margin from the bottom hinge to the floor to ⅛" between the door and jamb and nail the 5" bracket in the center

(15) Adjust the margin at the bracket located at the center of the of the jamb leg between the two hinges to ⅛" and nail.

(16) Adjust the margin at the other two brackets and nail.

(17) Remove the tack nail at the jamb head, and adjust the top corner of the hinge side jamb and nail both brackets.

(18) Adjust the margin at the door head on the strike side to ⅛" and nail the bracket at the jamb head.

(19) At the bottom of the strike jamb leg, adjust the margin to ⅛" and nail the bracket.

(20) Adjust the margin at the lock to ⅛" and nail the 5" bracket in the center

(21) Adjust the margin and nail the remaining brackets on the strike side.

(22) At this point, the door is adjusted and nailed on the inside or swing side. Open the door and step out to the outside or stop side.

(23) Close the door and at the bottom bracket on the lock side of the jamb push or pull the jamb leg so that the leg is square to the opening, and the door hits the stop. Nail the bracket.

(24) With the door closed, square the hinge side of the jamb and nail the bracket.

(25) Nail the four brackets at the top corners of the jamb and head.

(26) Using a straight edge, align the strike jamb from the top of the jamb where the bracket is nailed, to the bottom of the jamb leg. Nail the remaining brackets as the jamb is moved into alignment with the straight edge.

(27) Using a straight edge, align the hinge jamb from the top of the jamb where the bracket is nailed, to the bottom of the jamb leg. Nail the remaining brackets as the jamb is moved in alignment with the straight edge.

(28) Adjust the door stop if needed.

(29) Before the casings are installed, the splines need to be checked for any damage. If the spline is damaged, that portion will have to be cut and removed.

(30) If no damage was found, the casing can be installed. A dry fit is recommended to make sure the casing will fit properly. Set the head casing on the spline and tap into place. Next set one casing leg on the spline and put the miter together. Then, do the same to the other leg. If the casing miters and the revels on the jamb are correct, carefully remove the casing members.

(31) Apply a 1" bead of construction adhesive to the backside of the spline at the same location as the brackets, and at the mid-point between each bracket. Apply a glob of construction adhesive about the size of a nickel and ¼" high at the center of each bracket, at one side of the jamb only, starting at the miter. Place one of the casing legs on the spline and tap the first 1" to 2" into place on the spline.

(32) Apply a small amount of carpenters' glue to the miter on the casing leg. Next, install the head casing, starting at the miter, with the glue by tapping the head casing on the spline completely. With the head casing in place, finish installing the first casing leg on the spline. Apply a small amount of glue to the miter on the head casing and install the other casing leg starting at the miter and working to the bottom.

(33) Repeat steps (29) to (32) to install the casing on the other side of the jamb.

(34) Make any final adjustments to the door margins, stop, miters, or casing that may be needed.

(35) Allow the adhesive to dry 24 hours and prep for finishing.

Some Additional Notes on the Procedures Set Forth Above:

(1) This door installation procedure can be used with all doors, no matter what the shape, or the size.

(2) If metal stud framing is used, this door installation procedure would change from 1½" roofing nails to 1½" sheet metal screws. Everything else would remain the same.

(3) When using casing wider than 1½", construction adhesive should be applied to the bracket, and the back edge of the casing.

(4) If the door, jamb, and casing installed above had been pre-painted, then latex caulking color matched to the paint, would be applied at the joints where the jamb legs and jamb head are joined, at the casing and the jamb, and where the casing and drywall meet. In this case, latex color should also be applied at the miters, if needed.

Many variations on the above-described jamb assemblies are possible, such as mating jamb and fascia surfaces with various different shapes of splines, protrusions, grooves or other mating surfaces that facilitate attachment there between. Such variations are not to be regarded as a departure from the spirit and scope of the invention, but rather as modifications intended to be encompassed within the scope of the following claims.

What is claimed is:

1. A jamb assembly for placement in an opening in a wall, the jamb assembly comprising:

a jamb member having a jamb kerf formed therein;

a fascia member having a fascia kerf formed therein such that the fascia kerf is positioned in substantial alignment with the jamb kerf when the fascia member is located at the assembly position for assembling the jamb assembly;

a spline member, with the spline member, the fascia kerf and the jamb kerf being shaped and located so that a portion of the spline member protrudes into the jamb kerf and a portion of the spline member protrudes into the fascia kerf;

wherein the spline member has a generally rectangular cross-section.

2. The jamb assembly of claim 1 wherein the spline member, the jamb kerf and the fascia kerf are structured so that there is a friction fit between the jamb kerf, the spline member and the fascia kerf.

3. The jamb assembly of claim 1 wherein the spline is shorter than a length of the jamb member.

4. The jamb assembly of claim 1, wherein the fascia member is made of a composite material comprising an epoxy.

5. The jamb assembly of claim 4, Wherein the composite material further comprises wood material.

6. The jamb assembly of claim 1 wherein the jamb kerf and the fascia kerf are substantially rectangular in profile.

7. The jamb assembly of claim 6 wherein the spline member is shaped substantially as a rectangular prism.

8. The jamb assembly of claim 7 wherein a surface of the jamb member abuts a surface of the fascia member when the spline member is fully inserted into the jamb kerf and the fascia kerf.

9. The jamb assembly of claim 7 further comprising at least one angled member that is mechanically connected to the fascia member by adhesive material and is mechanically connected the jamb member.

10. The jamb assembly of claim 9 wherein the angled member includes a hole structured and located to facilitate mechanical connection between the angled member and the wall.

11. The jamb assembly of claim 1, wherein the spline comprises a friction fit assembly structured to connect the jamb member to the fascia member at least in part by a friction fit.

12. The jamb assembly of claim 1, wherein a surface of the jamb member abuts a surface of the fascia member defining a plane of abutment when the spline member is fully inserted into the jamb kerf and the fascia kerf, whereby the jamb groove and the fascia groove are in substantial alignment about the plane of abutment when the spline member is fully inserted into the jamb kerf and the fascia kerf.

* * * * *